US005957623A

United States Patent [19]

Sargent et al.

[11] Patent Number: 5,957,623

[45] Date of Patent: Sep. 28, 1999

[54] ELECTRICALLY INSULATED POSITIVE DRIVE BOAT LIFT

[75] Inventors: Charles L. Sargent, Bonita Springs; Daniel S. Carter, Fort Myers, both of Fla.

[73] Assignee: Quality Boat Lifts Inc., Fort Myers, Fla.

[21] Appl. No.: 09/023,144

[22] Filed: Feb. 12, 1998

Related U.S. Application Data

[63] Continuation-in-part of application No. 08/868,792, Jun. 4, 1997.

[51] Int. Cl.[6] ..... B63C 3/06; B63C 7/00; B63F 7/14

[52] U.S. Cl. ..... 405/3

[58] Field of Search ..... 405/3, 7, 198; 114/44, 48; 187/214, 210

[56] References Cited

U.S. PATENT DOCUMENTS

| | | | |
|---|---|---|---|
| 0,047,501 | 4/1865 | Turner | 114/44 |
| 516,032 | 3/1894 | Symonds | 405/198 X |
| 1,073,294 | 9/1913 | Siewert | 405/198 X |
| 2,091,156 | 8/1937 | Myers | 187/214 |
| 2,262,833 | 11/1941 | Clawson et al. | 187/214 |
| 2,569,837 | 10/1951 | Villars | 187/214 |
| 2,655,223 | 10/1953 | Villars | 187/214 |
| 2,687,617 | 8/1954 | Newell | 405/221 |
| 3,245,658 | 4/1966 | Sutton | 405/198 X |
| 3,276,211 | 10/1966 | Drake | 405/3 |
| 3,537,745 | 11/1970 | Herring | 187/214 X |
| 3,791,229 | 2/1974 | Litezki | 405/3 X |
| 3,958,664 | 5/1976 | Perkins | 187/214 X |
| 4,195,948 | 4/1980 | Vancil | 405/3 |
| 4,482,268 | 11/1984 | Stevenson et al. | 405/3 |
| 4,552,403 | 11/1985 | Yindra | 187/214 X |
| 4,678,366 | 7/1987 | Williamson | 405/3 |
| 5,314,263 | 5/1994 | Stokoe et al. | 405/3 X |
| 5,593,247 | 1/1997 | Endres et al. | 405/3 |
| 5,628,583 | 5/1997 | Gibson | 405/3 |

FOREIGN PATENT DOCUMENTS

| | | | |
|---|---|---|---|
| 865130 | 1/1953 | Germany | 405/3 |

*Primary Examiner*—Dennis L. Taylor
*Attorney, Agent, or Firm*—William E. Noonan

[57] ABSTRACT

A boat lift apparatus includes a support structure located proximate to a body of water. An elongate threaded shaft is located adjacent to the support structure and extends in a substantially vertical direction. A nut threadably engages the shaft. A boat accommodating platform is connected to the nut. The shaft is rotatably mounted to the support structure and selectively driven rotatably relative to the nut in a first direction to raise the nut relative to the shaft and in an opposite, second direction to lower the nut relative to the shaft. As a result, the platform and the boat accommodated thereon are selectively lifted and lowered relative to the body of water.

25 Claims, 12 Drawing Sheets

ELECTRICALLY INSULATED POSITIVE DRIVE BOAT LIFT

RELATED APPLICATION

This is a continuation in part of U.S. patent application Ser. No. 08/868,792, which was filed on Jun. 4, 1997.

FIELD OF THE INVENTION

This invention relates to an electrically insulated positive drive boat lift and, more particularly, to a boat lift that is especially suited for use with personal watercraft and other relatively small vessels.

BACKGROUND OF THE INVENTION

In conventional boat lifts, a boat or other type of watercraft is accommodated on a platform which is typically raised and lowered by a winch and cable mechanism. A wide variety of such lifts are known. However, virtually all exhibit one or more of a number of disadvantages.

The lift platform is usually raised by a motor or hand crank. To return the vessel to the water, the platform is lowered with the assistance of gravity. Most known boat lifts employ either a gear reduction or a separate brake mechanism to slow the descent of the platform. Such mechanisms contribute significantly to the complexity and expense of the boat lift.

Additionally, many standard cable-operated lift platforms experience problems with buoyancy. In order to properly lower the boat into the water, the hull of the vessel must be partially submerged. Most boat lift platforms employ structural components (e.g. cradle beams, bunk boards, etc.) that are composed of buoyant or low density materials such as wood or lightweight aluminum. Consequently, as the lift platform is lowered by gravity it tends to float on the water. This can prevent the hull of the watercraft from being properly submerged. Moreover, when the platform suddenly engages the water and floats, the cables may continue to unwind from the spool of the winch. This can cause the cables to unravel and tangle. Operation of the boat lift may be disrupted and costly, time consuming repairs may be required.

Standard cable driven boat lifts also employ a fairly intricate lifting mechanism. Typically, four sets of cables, pulleys and motors are required to raise and lower the lift platform. The cables perform the actual lifting and separate and distinct reduction means, which include gears and/or pulleys, provide the mechanical advantage required to produce the necessary lifting torque. Such structure is typically complex and expensive.

Conventional boat lifts also exhibit a number of safety problems. Most lifts are driven by an electric motor. Various parts of the lift, which are often metallic or otherwise electrically conductive, tend to frequently and repeatedly contact the water. In many cases, the conductive lift components are not adequately insulated from the drive motor and other electrical parts of the mechanism. This may result in a short circuit and a dangerous risk of electrocution. Cable driven boat lifts also experience broken cables, which can cause serious injury to a person in the vicinity of the boat lift.

Most standard boat lifts simply raise an vessel out of the water and lower the vessel into the water. Known lift platforms typically lack the ability to turn or otherwise adjust the position of the vessel after it has been raised. We have determined that it would be quite advantageous to be able to rotate a lifted vessel so that it can be moved conveniently onto an adjacent dock or other dry surface besides the boat slip. Such a feature would be particularly beneficial for personal watercraft and other small vessels.

Most known boat lifts do not take full advantage of the adjacent piling or support to bear the lift load. Indeed some known products utilize a relatively small base that supports the lift platform in a cantilevered manner. These types of lifts often exhibit less than satisfactory strength and durability. Typically they are limited to lifting fairly light loads. The lift components tend to shift and sag over time.

SUMMARY OF INVENTION

It is therefore an object of the present invention to provide a positively driven boat lift apparatus that operates reliably, safely and efficiently in two directions to selectively raise and lower a boat or other type of watercraft into or out of a body of water.

It is a further object of this invention to provide a positively driven boat lift apparatus that lowers a supported boat into a body of water safely and reliably without requiring a separate braking mechanism or complicated reduction means.

It is a further object of this invention to provide a positively driven boat lift apparatus, that resists buoyancy and submerges the lift platform sufficiently beneath the water such that the boat supported on the platform may be properly deployed in the water.

It is a further object of this invention to provide a positively driven boat lift apparatus that avoids the problems commonly associated with standard winch and cable lift assemblies, including unraveling, breaking and tangling of the cables.

It is a further object of this invention to provide a positively driven boat lift apparatus that overcomes the buoyancy of the lift platform components and the problems associated therewith.

It is a further object of this invention to provide a positively driven boat lift apparatus which is installed and operated in a simple, efficient and inexpensive fashion and that is significantly less complicated than standard cable driven lifts.

It is a further object of this invention to provide a positively driven boat lift apparatus that utilizes a standard piling to provide supporting strength and to guide the lift platform.

It is a further object of this invention to provide a positively driven boat lift that efficiently employs a single rotating screw to both lift the platform and provide mechanical advantage and resulting torque required for raising the platform.

It is a further object of this invention to provide a positive drive boat lift which eliminates the complexity, expense and maintenance that normally accompany the use of cables and separate reduction means.

It is a further object of this invention to provide an ergonomically pleasing boat lift.

It is a further object of this invention to provide an electrically insulated boat lift that significantly reduces the risk of short circuits and resulting electrical shock.

It is a further object of this invention to provide a positive drive boat lift that is significantly safer and sturdier than conventional boat lifts and which supports heavier loads than are handled by analogous known lifts.

It is a further object of this invention to provide a boat lift that takes advantage of an elongate vertical piling to more effectively support and distribute the compressive load and moment which are produced when a vessel is raised by the lift.

It is a further object of this invention to provide a boat lift that is automatically prevented from being raised or lowered beyond predetermined points and which avoids damage to the lift which can otherwise result from such movement.

It is a further object of this invention to provide a boat lift that is quick and convenient to start, stop, and operate in either an upward or downward direction.

It is a further object of this invention to provide a positive drive boat lift employing a self-lubricating screw drive, which requires low maintenance and features a long and effective operational life.

It is a further object of this invention to provide a boat lift apparatus that permits a personal watercraft or other vessel to be quickly and conveniently turned on the lift and positioned on a dock or other adjacent dry surface.

This invention results from a realization that a positively driven boat lift apparatus avoids a number of problems that are often associated with standard winch and cable driven boat lifts. Specifically, a positively driven boat lift employing a complementary threaded nut and shaft drive mechanism eliminates the difficulties associated with buoyancy and breaking, which are frequently exhibited by known lift devices. A positive screw driven boat lift apparatus also significantly reduces the complexity and expense of known devices because the screw drive both performs the lifting and provides the mechanical advantage and resulting torque required to perform the lifting. Cables and separate gear reduction means are eliminated. Additionally, we have realized that by mounting a rotating screw and insulated nut in respective, generally tubular guides and interengaging those guides through elongate, insulated bearing strips, significantly improved electrical isolation is achieved. Short circuits and the resulting risk of electrocution are reduced significantly.

This invention features a boat lift apparatus for use in combination with an elongate, generally vertical structural support located proximate a body of water. The apparatus includes an elongate, threaded shaft disposed adjacent to the support structure and extending in a substantially vertical direction. There are means defining a nut that threadably engages the shaft. Means define a boat accommodating platform, which is interconnected to the nut. There are means for rotatably mounting the shaft to the support structure and selectively driving the shaft rotatably relative to the nut in a first direction to raise the nut relative to the shaft and in an opposite, second direction to lower the nut relative to the shaft, whereby a platform and a boat accommodated thereon are selectively lifted and lowered relative to the body of water.

In a preferred embodiment, an elongate sleeve is attached to and generally axially aligned with the nut. The sleeve longitudinally receives the shaft as the nut is raised relative to the shaft and longitudinally discharges the shaft as the nut is lowered relative to the shaft. The sleeve may include means for lubricating the shaft as the shaft is received by and discharged from the sleeve. An elongate guiding member may be attached to the support structure and extend generally vertically along the support structure for accommodating the shaft. An elongate guided member may interconnect the nut and the platform and may interengage and be longitudinally movable in upward and downward directions relative to the guiding member. The guiding member may include a longitudinal channel that telescopically receives the guided member. The elongate sleeve may be attached to and generally axially aligned with the nut and may telescopically receive the shaft. The guided member may include a longitudinal channel through which the sleeve extends and within which the nut is fixed to the guided member. Thrust bearing means may rotatably interconnect the shaft and the guiding member.

Pivot means may connect the platform to the guided member such that the platform is pivotable about a generally vertical axis to adjust the position of a vessel supported on the platform relative to the support structure. The pivot means may include a general cylindrical inner member fastened to and depending from the guided member and a tubular outer member disposed rotatably about the inner member. Means may be provided for interconnecting the tubular member and the platform and means may be employed for restricting the tubular member from being separated from the inner member. Collar means may be attached to the inner member for supporting the tubular member thereon. Pivot bearing means may be provided for interengaging the tubular member and the collar means. Guide bearing means may be carried by the collar means for interengaging the support structure and constraining the position of the platform relative to the support structure when the platform is lifted and lowered. The guided member may include an interior channel and may further include a reinforcing component that is received by the interior channel and extends into the cylindrical member.

Means may be provided for locking the platform within a selected one of a plurality of angular positions about the generally vertical axis. The means for locking may include a locking plate attached to the guided member and having a plurality of latching slots formed therein. A latching pin may be retractably mounted to the platform. The pin is engaged with a selected one of the slots to lock the platform in a corresponding angular position and is retractably disengaged from the slots to permit the platform to be pivoted about the generally vertical axis.

Elongate bearing strip means may interengage the guiding member and the guided member. Such elongate bearing strip means electrically insulate the guiding member from the guided member. An upper limit switch may direct the means for mounting and driving to stop rotation of the shaft and raising of the platform when the guided member reaches a predetermined uppermost position. Lower switch means may direct the means for mounting and driving to stop rotation of the shaft and lowering of the platform when the guided member reaches a predetermined lowermost position.

The platform may include a cradle and means may be provided for interconnecting the cradle to the tubular member such that the cradle extends outwardly from the tubular member in a cantilevered manner. The platform may include a plurality of elongate bunk components mounted transversely to the cradle. The cradle may include a plurality of laminar members. The cradle may also include upper and lower brackets sandwiched about the laminar members and fixed to the tubular member.

Activation switch means may be provided for selectively activating and deactivating the means for turning and for selecting the direction in which the shaft is turned when the means for turning are activated. The activation switch means may be alternatable among a first state for deactivating the means for turning such that the platform does not move vertically, a second state for activating the means for turning to raise the platform, and a third state for activating the means for turning to lower the platform. Actuator rod means may be provided for selectively alternating the activation switch among the first, second and third states. The means for mounting and driving and the activation switch means are preferably disposed in a housing mounted to the support structure. The actuation rod means typically includes an elongate rod that is mounted within and suspended from the housing. Means are connected to the rod for selectively engaging the activation switch means and for urging the activation switch means into the second state when the rod is pushed longitudinally in an upward direction, and into a third state when the rod is pulled downwardly in a longitudinal direction and for permitting the activation switch to maintain the first state normally. The rod may be axially rotatably mounted in the housing and a light may be attached to the housing. A light switch may be mounted in the housing and electrically connected to the light. Cam means carried by the rod are interengaged with the light switch when the rod is rotated in a first direction for operating the light and are disengaged from the light switch when the rod is rotated in an opposite direction for deactivating the light.

BRIEF DESCRIPTION OF THE DRAWINGS

Other objects, features and advantages will occur from the following description of preferred embodiments and the accompanying drawings, in which.

DETAILED DESCRIPTION OF PREFERRED EMBODIMENTS

Figure 1:
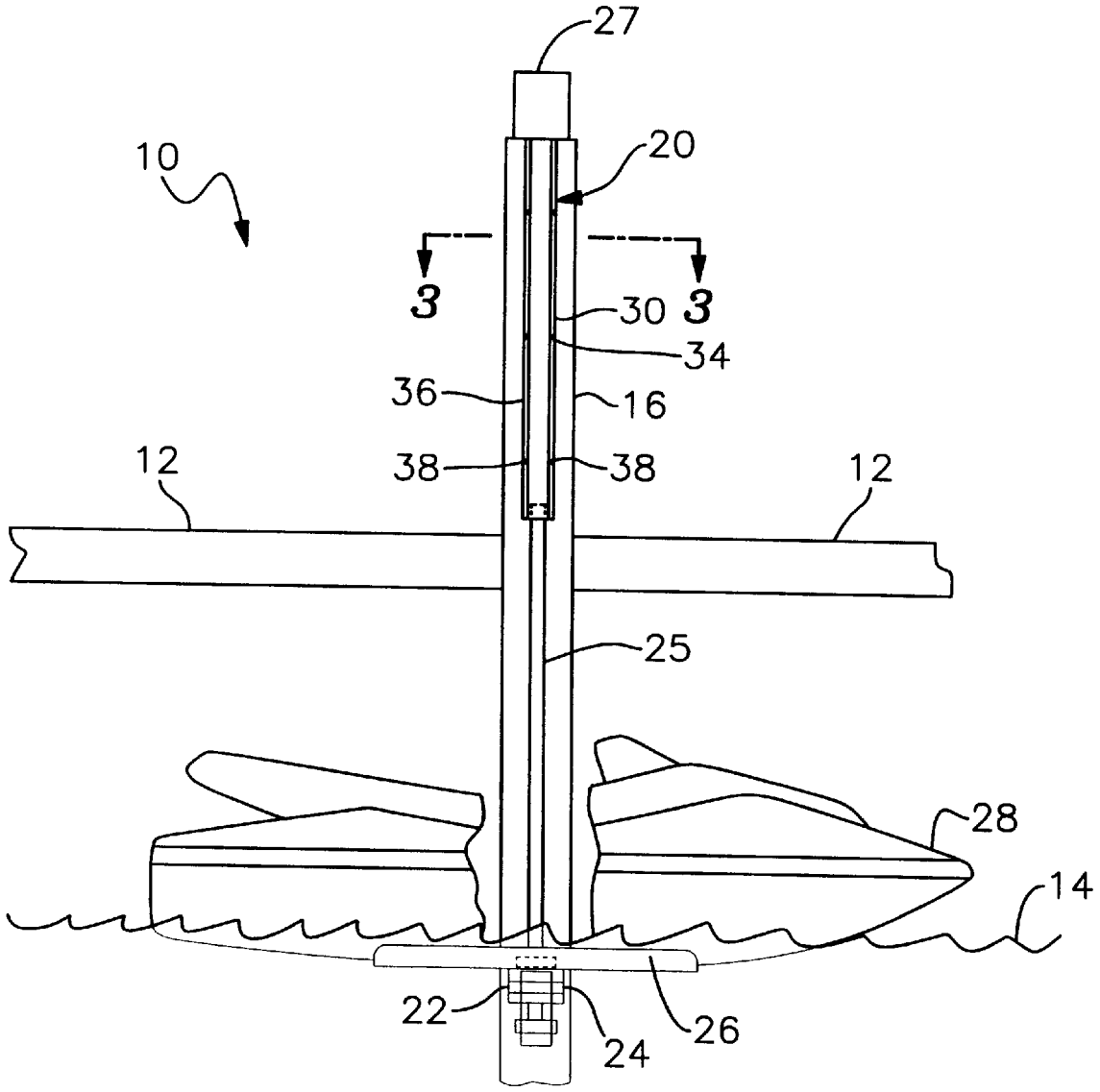
FIG. 1 is an elevational, side view of a preferred boat lift apparatus according to this invention, which apparatus has a personal watercraft mounted thereon.
Figure 2B:
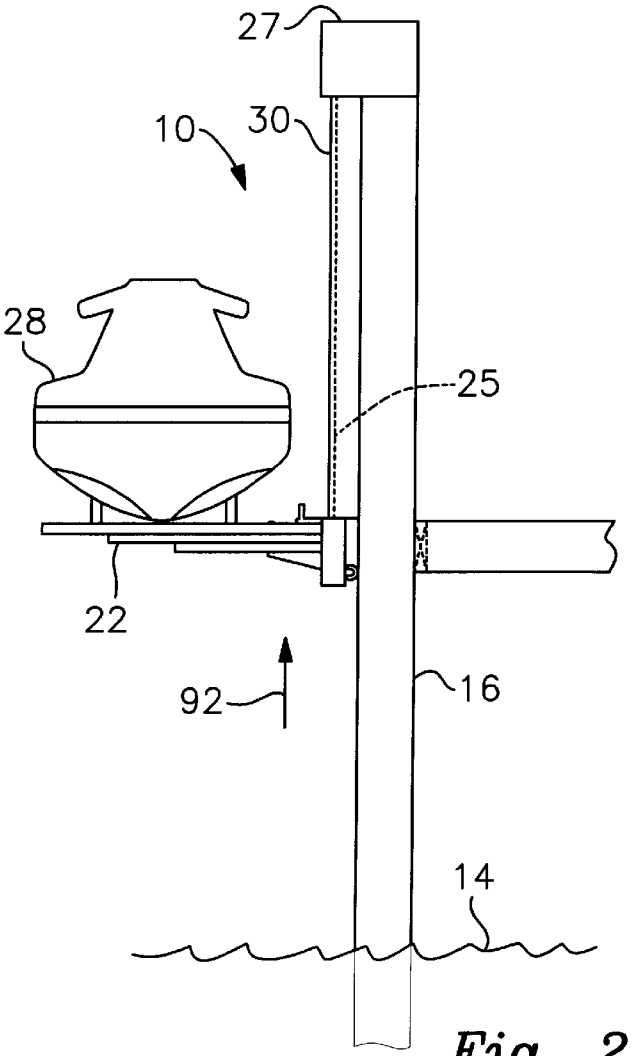
FIG. 2B is an elevational side view, similar to FIG. 2A, of the boat lift in a raised condition.
Figure 2A:
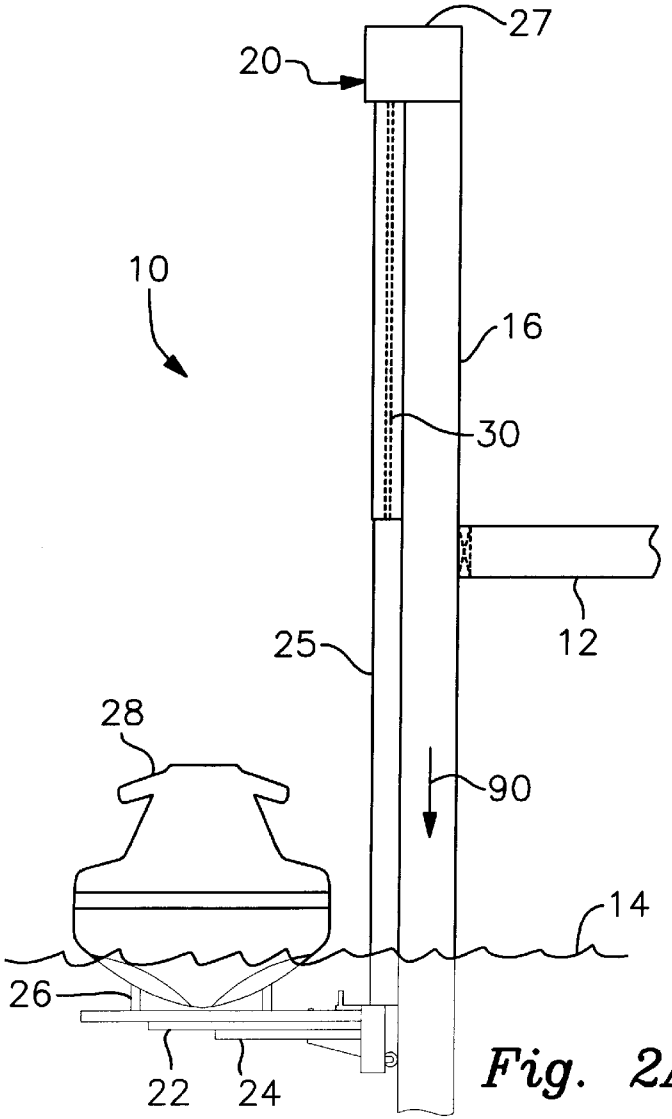
FIG. 2A is an elevational end view of the boat lift apparatus of FIG. 1.

There is shown in FIGS. 1 and 2A and 2B a positive drive boat lift apparatus 10. The boat lift is mounted beside a dock or pier 12, which extends into a body of water 14. A vertical support structure 16, which typically comprises a piling, is disposed adjacent to dock 12. The piling is disposed in, adjacent to, or otherwise proximate water 14. As used herein, "proximate" means any of the known ways that the piling may be positioned relative to the water. In some cases, a plurality of pilings are utilized to support the dock. In other embodiments, a piling or other support structure 16, which is independent of a dock, may be utilized.

Lift 10 features a positive actuator assembly 20. A lift platform 22 is interconnected to and extends from a lowered end of assembly 20 in a cantellivered manner. Platform 22 comprises a cradle 24 that is secured pivotally to the lower end of assembly 20 in a manner that will be described more fully below. A pair of bunk boards 26 are attached to and extend transversely across the upper surface of cradle 24. Again, this manner of attachment is described more fully below. The bunk boards support a personal watercraft 28 in a more or less conventional manner. It should be noted that other types of small vessels may be similarly supported by platform 22. As with other known boat lifts, the purpose of lift 10 is to selectively raise and lower watercraft 28 relative to water 14 and dock 12. The level to which watercraft 28 may be raised or lowered is selected according to the particular tide that exists when the lift is operated. It should be noted that, in alternative embodiments, lift 10 may include one or more pair of actuator assemblies 20, located along the port and/or starboard sides of the vessel. Larger multiples of actuator assemblies may be employed for use with larger boats. For smaller vessels, such as personal watercraft 28, only a single assembly 20, as shown, may be needed. In certain versions, for larger vessels, a pair of assemblies are formed along only one side of the vessel. In other versions equal numbers of assemblies are provided on both sides. In still other versions, three assemblies may be used with a substantially triangular platform. Such embodiments use three drive motors and three pilings, which respectively support the motors. Two pilings are disposed on one side and one piling on the other side of the vessel.

Figure 3:
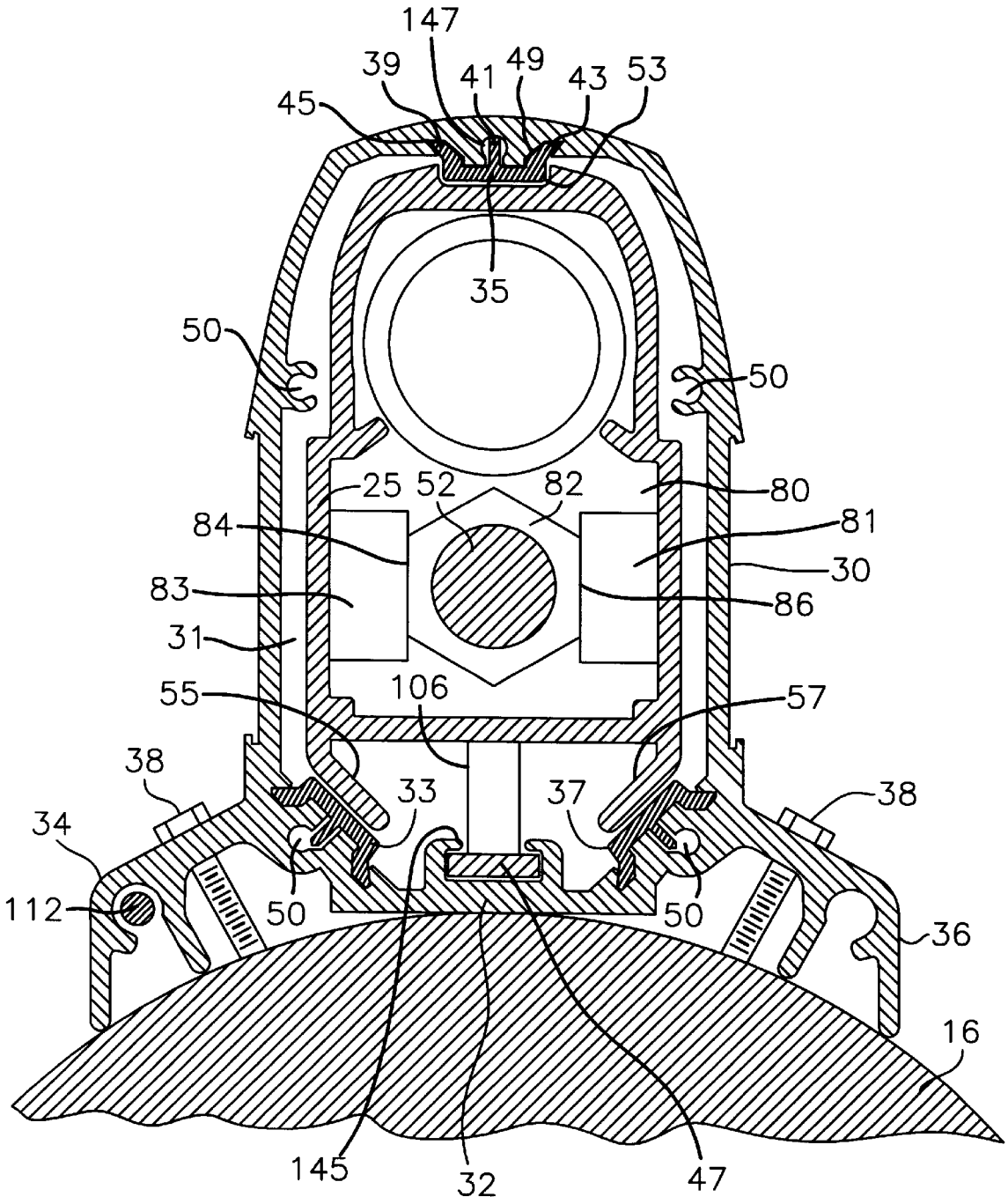
FIG. 3 is a cross sectional view taken along line 3—3 of FIG. 1.

As shown in FIGS. 1 and 2A, a rotatable drive mechanism 27 is secured by bolts, brackets or other standard means of attachment to the upper end of piling 16. The internal structure and specific operation of mechanism 27 are described more fully below. An elongate tubular guiding member 30 is attached to and depends vertically from mechanism 27. The exterior configuration of guiding member 30 is omitted and that component is shown in a simplified manner for clarity in FIGS. 1, 2A and 2B. A more detailed exterior configuration is illustrated in FIG. 3. An elongate guided member, comprising a generally tubular guided member 25 is telescopically received by guiding member 30 and is shown depending therefrom in FIGS. 1 and 2A. Platform 22 is attached to and extends outwardly from guide 25 in a cantilevered manner. Mechanism 27 is operably interengaged with guiding member 30 and guided member 25 such that operation of mechanism 27 in a first direction of rotation causes guided member 25 to extend longitudinally from the lower end of guide 30. This lowers platform 22 into water 14, in the manner shown in FIG. 2A.

When mechanism 27 is driven rotatably in the opposite direction, guided member 25 is telescopically retracted into guiding member 30. As a result, platform 22 and watercraft 28 supported thereon are raised above the water in the manner indicated by FIG. 2B.

Figure 4:
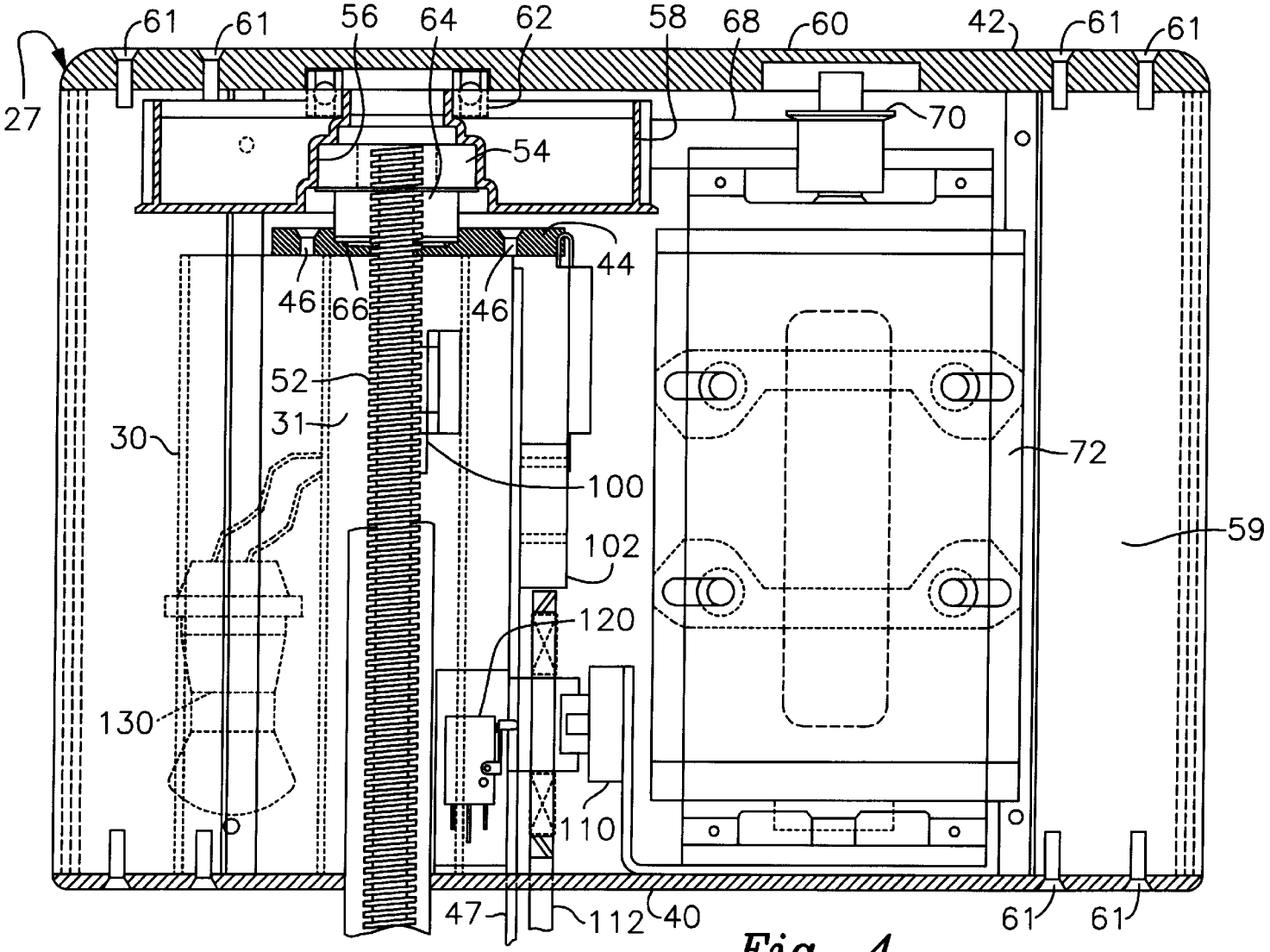
FIG. 4 is an elevational, cross sectional view of the drive housing and the components contained therein.

Guide 30 has the cross sectional shape shown in FIG. 3. The tubular guide is composed of a durable metal or synthetic material that is capable of withstanding marine conditions. It may be extruded or constructed according to other known techniques. The guide includes an inner vertical surface 32 and a pair of extruded wing portions 34 and 36 that engage the side of piling 16. A plurality of bolts 38 interconnect the wings and piling 16, and thereby secure guiding member tube 30 to the piling. As best shown in FIG. 4, the upper end of guiding member 30 is received within housing 42 of drive mechanism 27. More particularly, guide 30 extends through an opening in the floor 40 of housing 42. The housing includes a side wall 59. Floor 40 and an upper plate 60 are secured to side wall 59 by respective screws 61. A shaft mounting plate 44 is secured to the upper end of guide tube 30 by bolts 46 that interengage respective holes in plate 44 and corresponding holes 50 (FIG. 3) in guide tube 30. As best shown in FIGS. 1 and 2A, the lower end of guide 30 extends to a point along the piling that is level with or slightly above dock 12.

Internally, guide 30 includes a longitudinal channel 31, FIG. 3. A plurality of elongate bearing elements 33, 35 and 37 are attached to the inside wall of guide 30 and extend longitudinally for most, if not the entire length of the tubular guide. More particularly, elements 33, 35 and 37 are wear strips composed of an insulating material. Each of these elements includes a plurality of legs 39, 41 and 43 which are snap fit or otherwise inserted in respective receptacles 45, 147 and 49 in guide 30. A longitudinal track 145 is formed on the inside of guide wall 32. Track 145 accommodates a lower limit switch actuation bar 47. The operation of that bar is described below.

As shown in FIGS. 1–4, guiding member tube 30 accommodates an acme threaded screw shaft 52. As best illustrated in FIG. 4, the shaft is secured at its upper end to a tapered hex stock element 54. This element is fixed within a complementary shaped axial recess 56 of a toothed gear or pulley wheel 58. The wheel is itself axially rotatably mounted between shaft mounting plate 44 and upper plate 60 of housing 42. Upper plate 60 contains a bearing assembly 62. As a result, wheel 58, which is sandwiched between hex stock 54 and bearing assembly 62, is permitted to rotate within housing 42. Shaft 52 is suspended from hex stock 54 and extends through an opening in plate 44 and into and through the elongate channel 31 of guiding member 30. Shaft 52 is supported by a tapered roller thrust bearing 64 that is seated within a recess in the upper surface of plate 44. An O-ring 66 is interposed between bearing 64 and plate 44. This seals grease from leaking from bearing 64. Threaded shaft 52 is axially rotatably interengaged with and suspended longitudinally through guiding member 30. The shaft extends longitudinally through channel 31 of guide 30.

Figure 5:
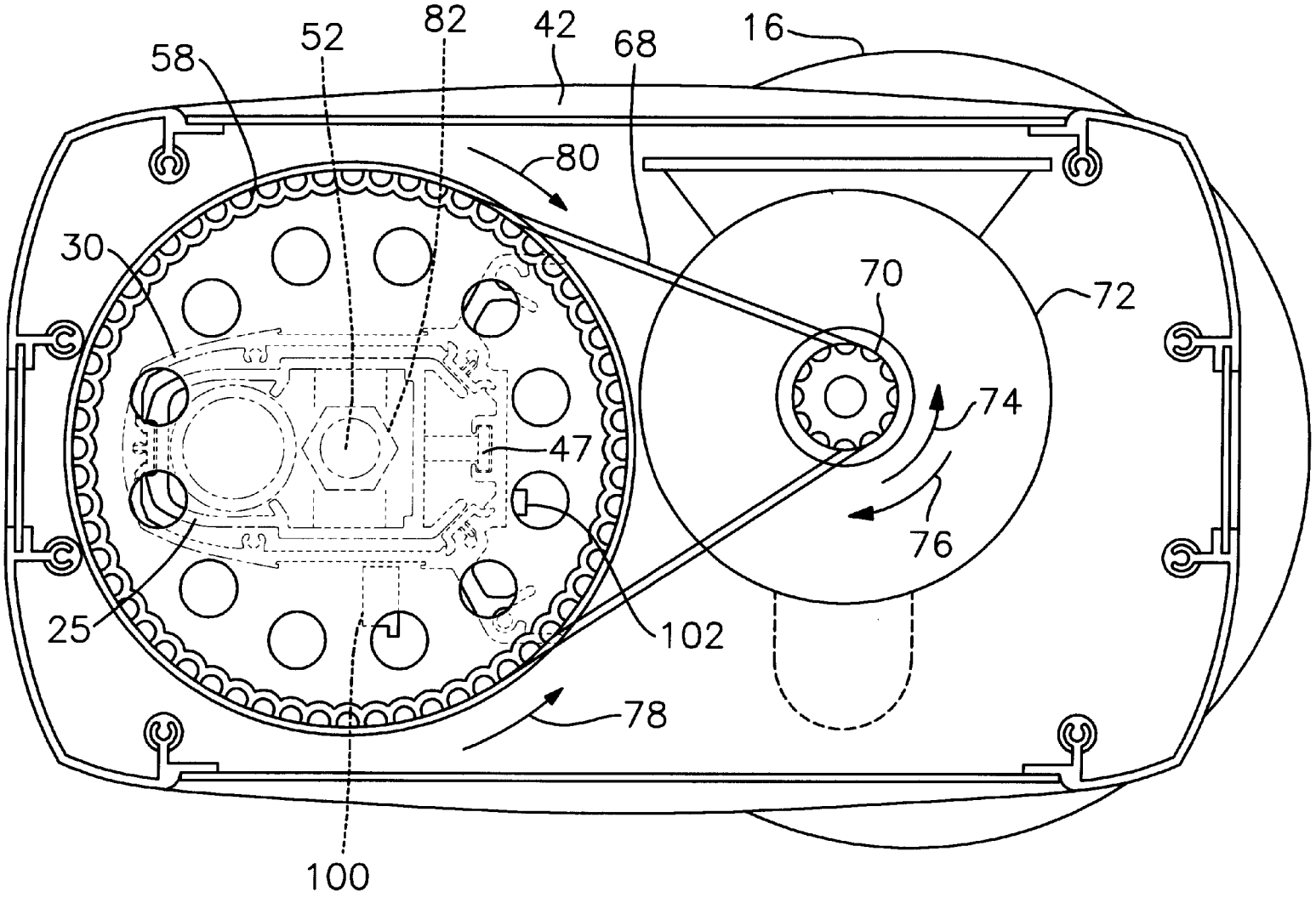
FIG. 5 is a top view of the drive mechanism depicted in FIG. 4.

As illustrated in FIG. 5, wheel 58 has a toothed circumferential surface. A complementary toothed pulley belt 68 operably interconnects wheel 58 with a pulley hub 70 of two-way drive motor 72. See also FIG. 4. Motor 72 features a standard construction. The motor is started in a manner that will be described more fully below such that hub 70 is driven selectively in either the direction of arrow 74 or the opposite direction of arrow 76. Such operation causes belt 68 to drive wheel 58 in the direction of either arrow 78 or arrow 80, respectively. This rotates shaft 52 in a like axial direction within guiding member 30. More particularly, the hex stock 54 that interconnects wheel 58 and shaft 52 is axially driven by the rotating wheel to turn the shaft. As the wheel turns, it rotatably interengages housing 42 through bearing 62. Likewise, shaft 52 rotatably interengages plate 44 of guiding member 30 through tapered thrust bearing 64, which effectively suspends the screw shaft through the guiding member. It should be noted that assorted known types of drive motors may be employed. Additionally, the means for interconnecting the drive motor and the shaft may include various known types of belts, chains and pulleys.

Figure 6:
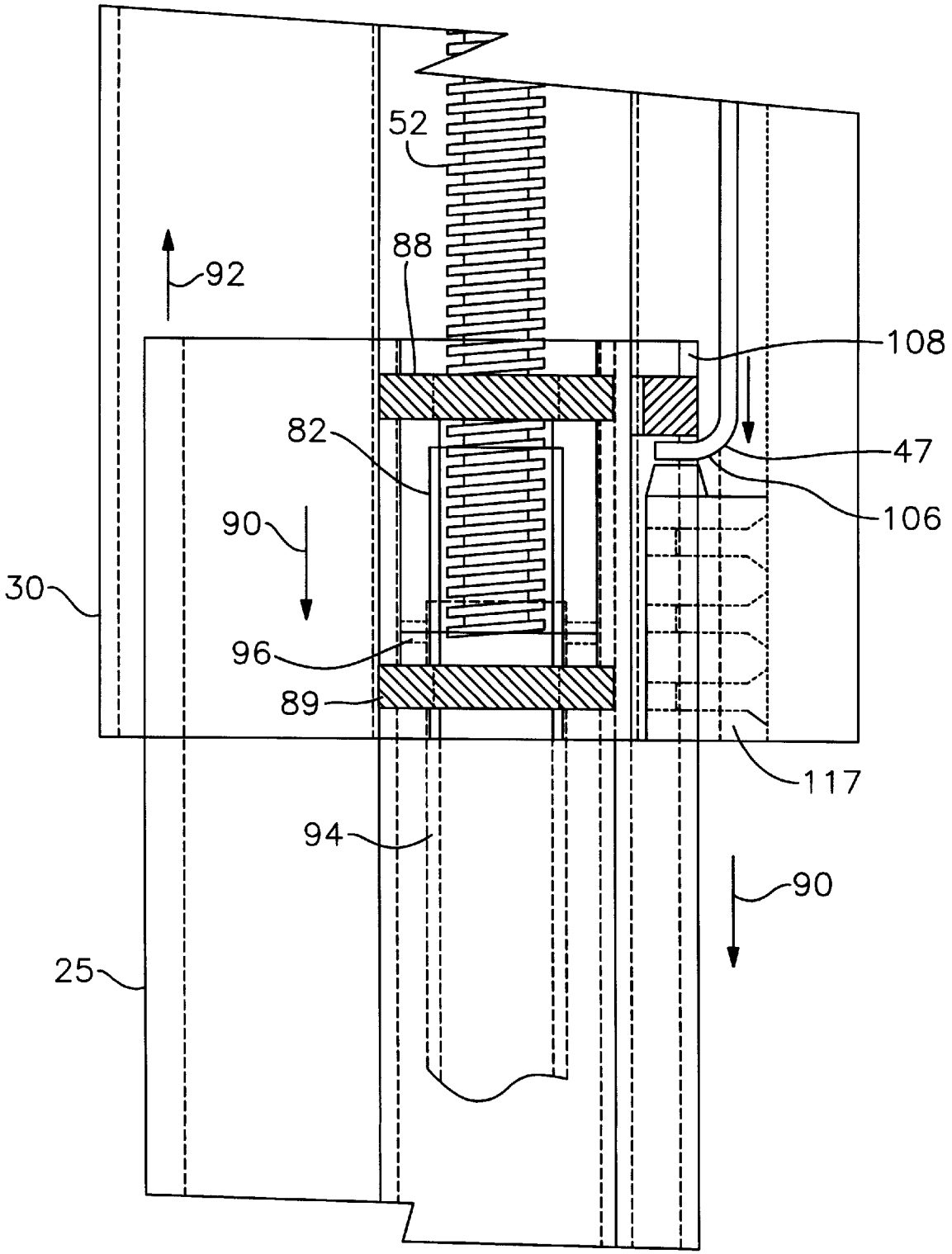
FIG. 6 is an elevational view of the lower end of the shaft as interconnected to the upper end of the lubricating sleeve and disposed within the guided member; the lower limit switch is also depicted.

Guided member 25 is telescopically interengaged with guiding member 30 in the manner shown in FIGS. 3, 4 and 6. In particular, guided member 25 is received slidably within longitudinal channel 31 of guide 30. The guided member includes its own longitudinal inner channel 80, FIG. 3, through which shaft 52 is telescopically received. A longitudinal recess 53 formed in guide 25 is interengaged by bearing strip 35 carried by guiding member tube 30. The guided member further includes a pair of longitudinal flanges 55 and 57 that interengage insulated bearing strips 33 and 35, respectively. The guide 25 is composed of materials identical or similar to those composing guide 30. Each of the members 25 and 30 may comprise a single elongate piece, as shown herein, or multiple interconnected segments.

A plastic or otherwise insulated nut component 82 is attached to guided member 25 proximate the upper end of that guide and, more specifically, is carried fixedly within channel 80. Nut 82 is approximately 2 inches long and includes an axis that is aligned with or parallel to the longitudinal axis through channel 80. The nut includes a pair of flat surfaces 84 and 86, best shown in FIG. 3. Opposing pieces of flat stock 81 and 83 interengage surfaces 84 and 86 with the inner side walls of guide 25 and prevent the nut from rotating within the guided member. As best shown in FIG. 6, thrust plates 88 and 89 are welded above and below nut 62, respectively. These plates hold nut 82 and flat stock pieces 81 and 83 fixed in place in guide 25. As a result, nut 82 is effectively secured to and carried by guide 25.

Nut 82 is threadably interengaged with screw shaft 52. Accordingly, the nut travels along the shaft as the shaft is rotated. When the shaft turns in the counterclockwise direction of arrow 78, shown in FIG. 5, nut 82 is lowered along shaft 52, as indicated by arrow 90 in FIG. 6. At the same time, guided member 25, which is fixedly attached to nut 82, is lowered longitudinally within guide 30 and discharged from the lower end of the guiding member 30, likewise in the direction of arrow 90. This lowers attached platform 22 and watercraft 28 into the water, as shown in FIG. 2A. Conversely, when the shaft is driven in the clockwise direction of arrow 42, FIG. 5, nut 82 is pulled upwardly along shaft 52. As a result, guided member 25 is retracted upwardly within guiding member 30 in the direction of arrow 92, FIG. 6. The attached platform 22 and the watercraft 28 supported thereon are thereby raised into the position shown in FIG. 2B.

As best shown in FIG. 6, an elongate lubricating tube 94 is generally axially aligned with and fixedly secured to nut 82. Tube 94 extends longitudinally through channel 80 of guided member 25. The lubricating tube is composed of metal, PVC or other materials similar to that composing the guiding and guided members. The upper end of tube 94 extends through plate 89 and is press fit into nut 82 and fixed thereto by set screws 96. Tube 94 telescopically receives the shaft as nut 82 and attached guided member 25 are raised and lowered relative to shaft 52 and guiding member 30.

More particularly, the shaft is received by tube 94 as nut 82 and tube 94 are raised. By the same token, the shaft is discharged from the upper end of tube 94 as the nut and lubricating tube are lowered. Tube 94 contains grease or other lubricating material that lubricates rotating shaft 92 as the nut and attached tube are raised and lowered along shaft 52. The shaft is therefore self-lubricating during operation of boat lift apparatus 10.

Lift 10 employs assorted switches that achieve significant benefits in accordance with this invention. As best shown in FIGS. 4 and 5, upper and lower limit switches 100 and 102 are mounted to guiding member 30 by respective brackets that are either welded or bolted to the guiding member. Switches 100 and 102 are electrically connected to drive motor 72 in a standard manner. Normally, each of those switches maintains a first state, wherein the motor 72 is allowed to drive the shaft 52 to either raise or lower the guided member, as required. When either of switches 100 or 102 is switched into its second state, the operation of motor 72 is halted.

Switch 100 serves as an upper limit switch. It is normally closed so that the motor may be operated when needed to either raise or lower the guided member. When the lift is raised and guided member 25 is fully retracted within guiding member 30, the upper end of guide 25 engages the contact of switch 100 and alternates that switch into its second, open state. This stops the motor and holds guided member 25 and attached platform 22 in the fully raised position shown in FIG. 2A. Further elevation and potential damage to the boat lift are prevented. The guided member and attached platform now may be lowered only.

Figure 7:
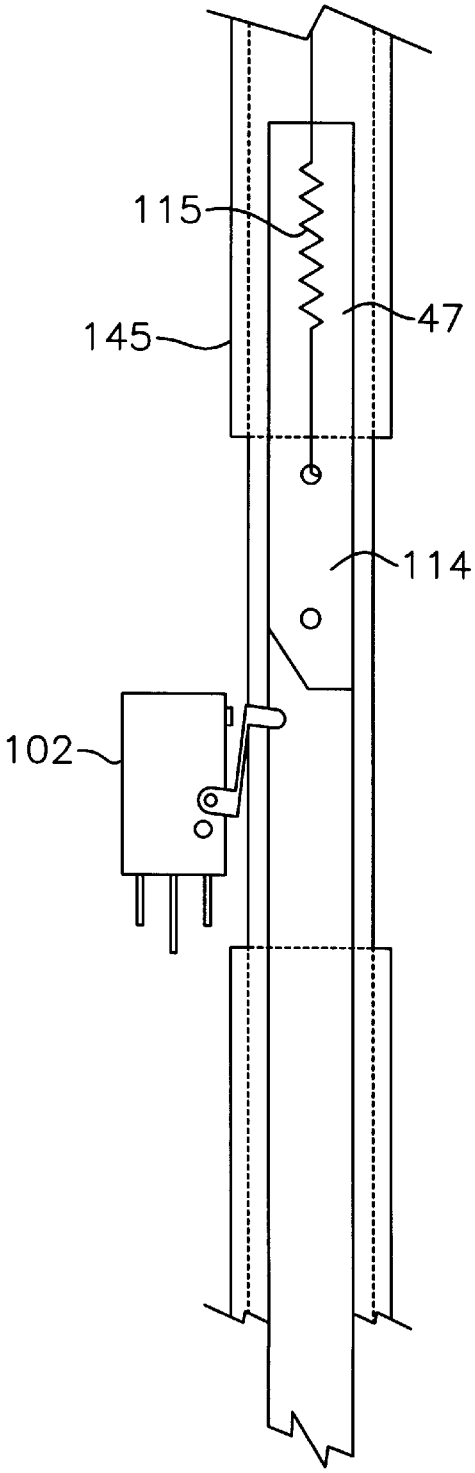
FIG. 7 is an elevational view of the lower limit switch and the actuation bar and cam for operating that switch; the bar is positioned such that the switch is open.

Switch 102 operates as a lower limit switch. That switch is operably interconnected to switch actuation bar 47 shown in FIGS. 3–8. As best shown in FIG. 6, the lower end of bar 47 includes a perpendicular portion 106, see also FIG. 3. Portion 106 is received within a notch or recess in guided member 25. When the guided member is retracted within the guiding member or is at any position other than its lowermost point within the guiding member, perpendicular bar portion 106 is spaced apart from an upper lip 108 of guided member 25. As shown in FIG. 7, bar 47 carries a cam 114. The bar and cam are biased upwardly by a spring 115 interconnected between cam 114 and track 145. The cam does not engage switch 102 and that switch is open. As a result, the second limit switch 102 permits motor 72 to lower the lift.

Figure 8:
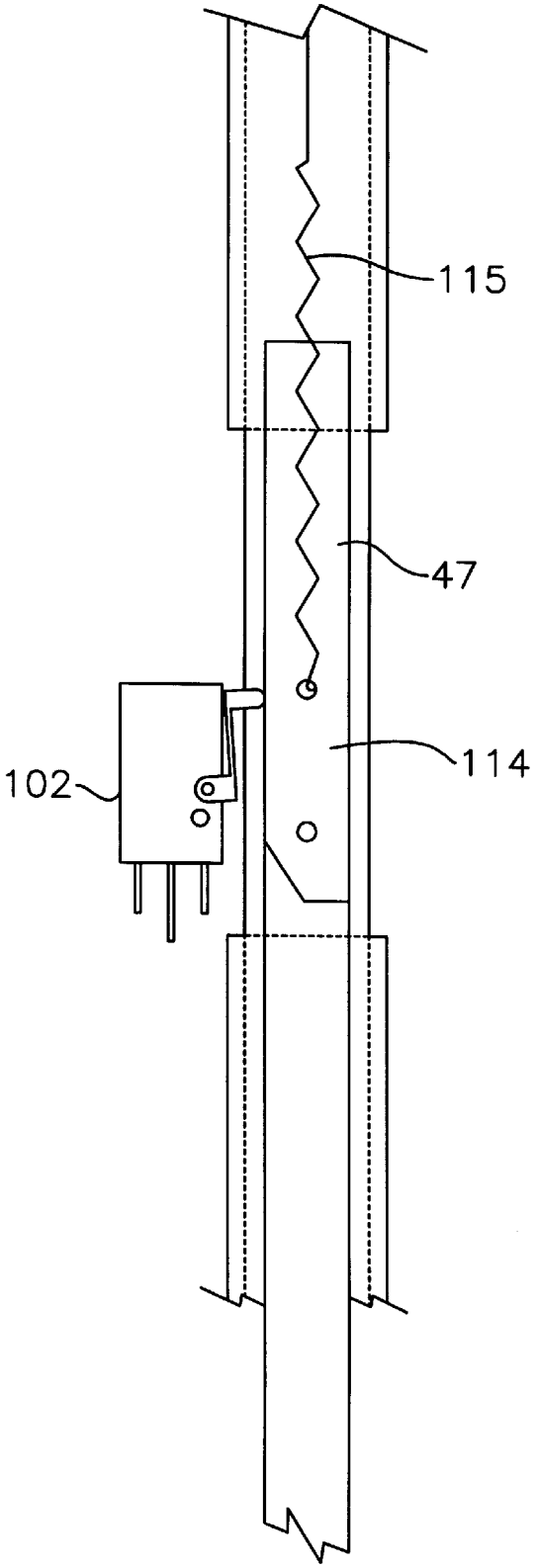
FIG. 8 is a view similar to FIG. 7 of the lower limit switch and actuation bar, with the bar pulled into a second position wherein the switch is closed by the cam.

When guided member 25 drops in the direction of arrow 90, FIG. 6, it eventually reaches a point proximate the lower end of guiding member 30. At that point, lip 108 engages perpendicular portion 106 of bar 47 and pulls that rod downwardly so that switch 102 is engaged by cam 114, as shown in FIG. 8, and closed. This stops motor 72 and prevents any further lowering of guide 25 and attached platform 22. The motor is now permitted to turn only in a direction that will raise the guided member relative to the guiding member. Separation of the guides is thereby prevented. Lower limit switch 102 therefore limits the degree to which the platform and supported watercraft may be lowered into the water. That lowermost point is illustrated in FIG. 2A. A stop 117, FIG. 6, prevents separation of the guided member tube from the guiding member tube in the event the lower limit switch fails. The stop is attached to guide 30 by bolts 119 and engages and blocks lip 108 if switch 102 fails and the lip reaches the stop.

Figure 9:
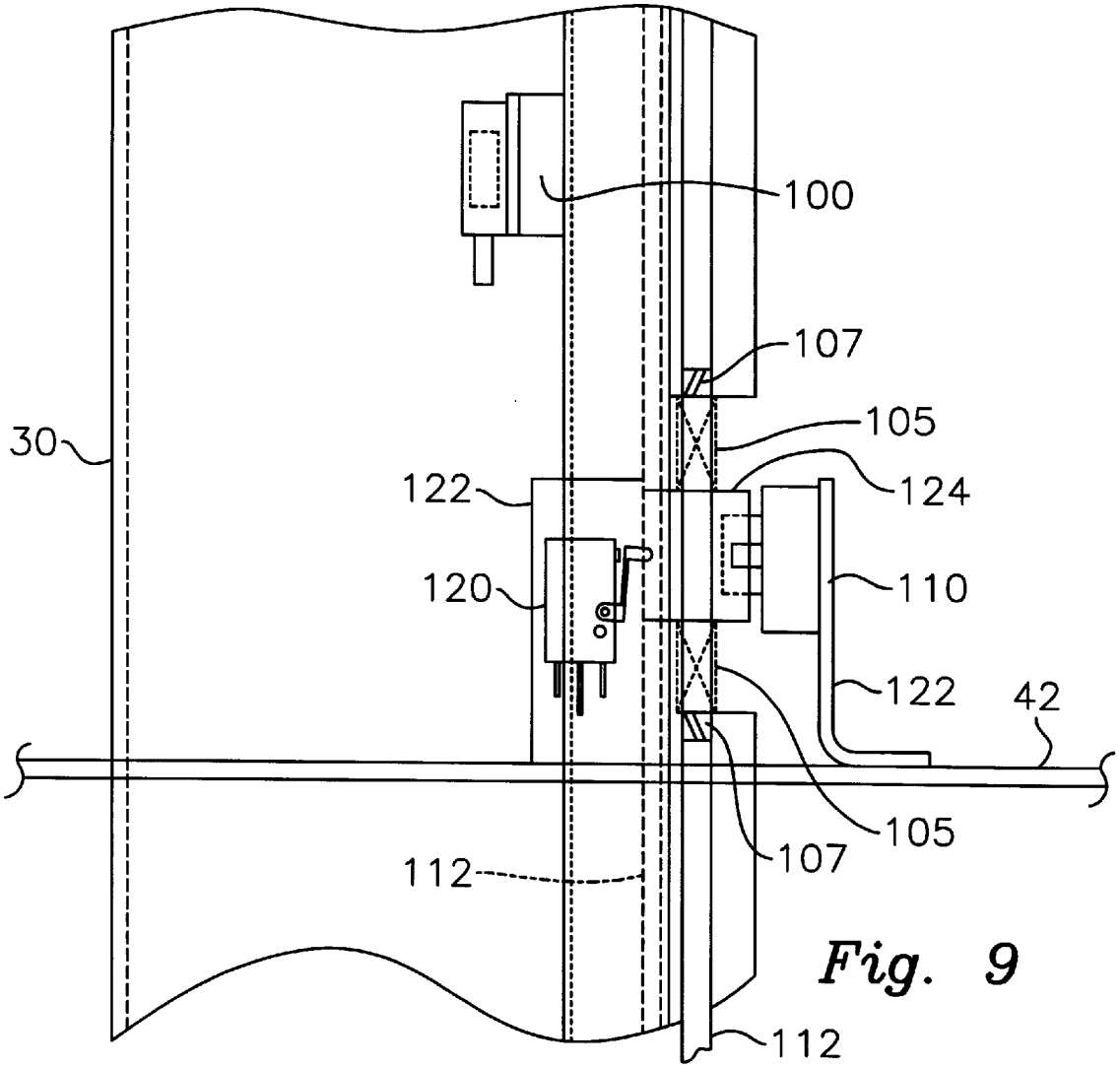
FIG. 9 is an elevational view of the activation switch and light switch, as well as the rod for operating those switches; the upper limit switch is also shown.
Figure 10:
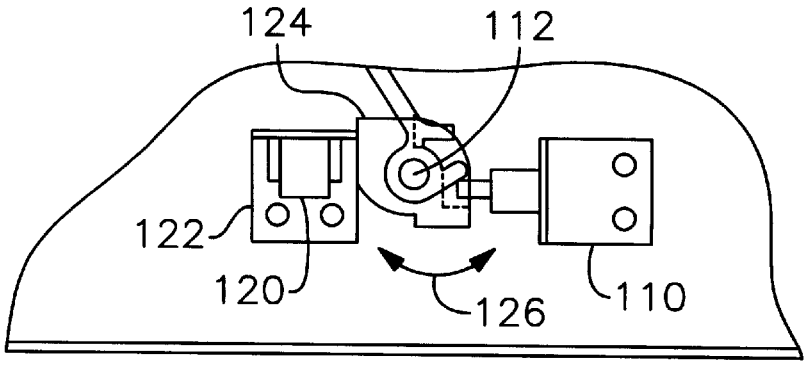
FIG. 10 is a top plan view of the activation switch and light switch, as well as the actuation rod and cam used in connection with these switches.

A three-way activation switch 110 is also mounted to guiding member 30 within housing 42, as shown in FIGS. 4, 9 and 10. Switch 110 is a momentary toggle switch that features three states. The switch is interconnected to and controls operation of drive motor 72 in a known manner. In a first state, the switch deactivates the motor and the lift is neither raised nor lowered. In a second state, the motor is directed to turn the shaft in a first direction, which raises the lift. In the third state, the motor is directed to operate in the opposite direction, which lowers the lift.

Switch 110 is itself conveniently operated by a switch activation rod 112, FIGS. 9 and 10. Rod 112 carries a cam element 124, which is positioned between activation switch 110 and a light switch 120. A pair of compression springs 105 are positioned respectively above and below cam element 124. Each of the springs is wound about rod 112 and is interengaged between the cam element 124 and a respective seat or detent 107 in guide 30. The springs 105 hold rod 112 and attached cam element 124 in a generally neutral position adjacent switch 110. In this neutral position, switch 110 is in its first state and the motor is deactivated.

The lower end of rod 112 includes a knob or handle (not shown) that is easily accessible to the operator below housing 42. When the operator grasps the handle and pulls it in a vertically downward direction, switch 110 is urged by cam 124 into its third state, which causes the boat lift to be lowered. As the rod is pulled lower, spring 105 is resiliently compressed, When the handle is released, that spring returns the cam to the neutral position to deactivate motor 72. Alternatively, if the handle is grasped and pushed upwardly, upper spring 105 is resiliently compressed and switch 110 is alternated by cam 124 into its second state, which raises the boat lift. If rod 112 is neither raised nor lowered, the springs maintain the rod in its neutral condition, which allows switch 110 to maintain its first deactivated state. The lift remains vertically stationary.

A light switch 120 is mounted by a bracket 122 within housing 42, as shown in FIGS. 9 and 10. Switch 120 comprises a standard on/off switch. When the rod 112 is grasped by the above described handle, it may be axially rotated in the manner indicated by double headed arrow 126 in FIG. 10. As a result, cam 124 may be rotated between a first condition, which urges switch 120 into the "on" state and a second condition, which urges switch 120 into the "off" state. When switch 120 is "on" a light 130, FIG. 4, is activated. Alternatively, when switch 120 is "off", light 130 is deactivated. As a result, rod 112 is accessed to quickly and conveniently start and stop the boat lift. It also permits the direction of travel to be selected. Finally, rod 112 allows light 130 to be selectively turned on and off. The user is thereby provided with a number of quick and convenient features that are hereto unavailable on conventional lifts.

Figure 11:
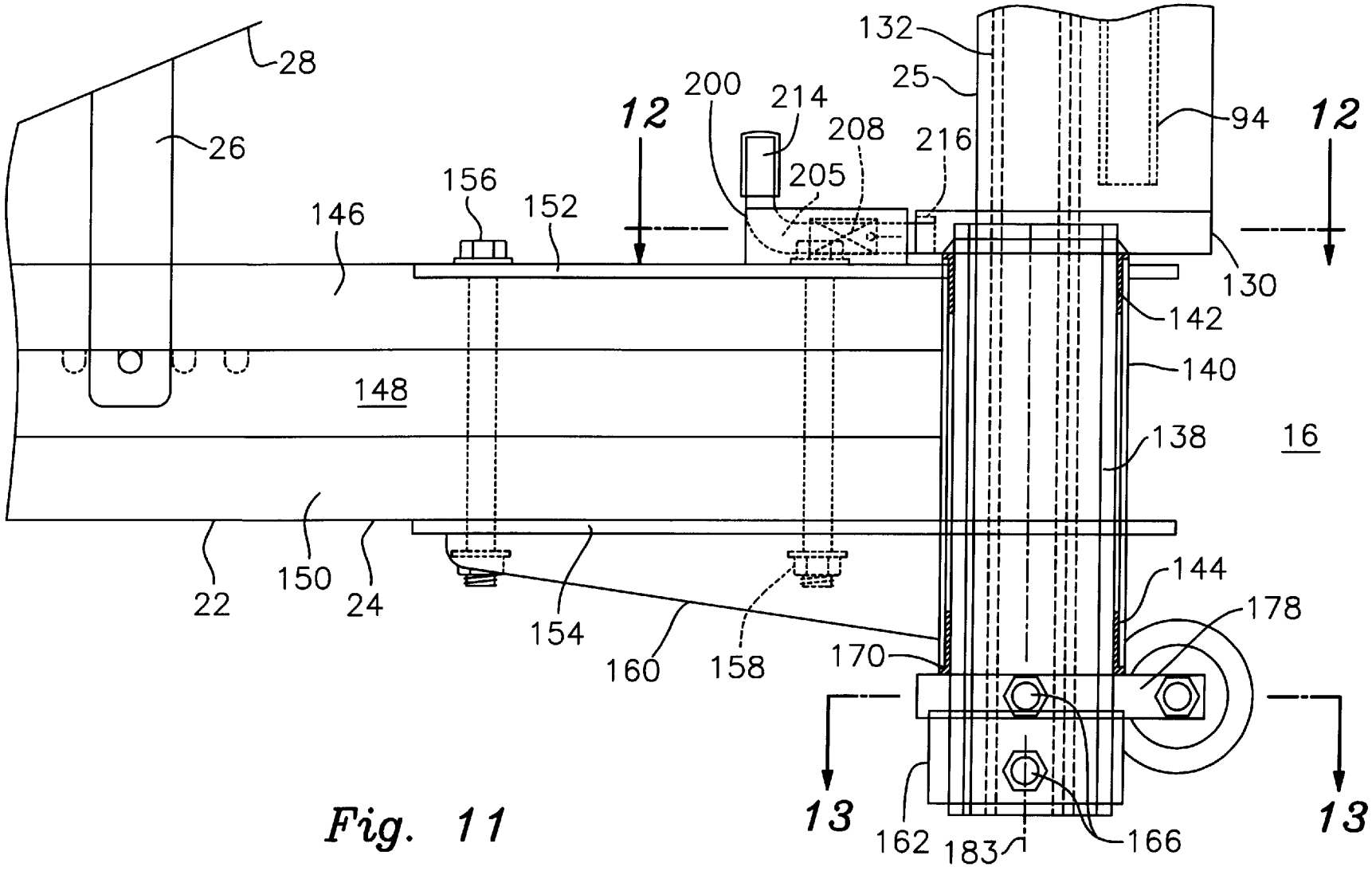
FIG. 11 is an elevational side view of the lower end of the boat lift apparatus and particularly illustrating the means by which the platform is pivotally connected to the lower end of the guided member; the lower roller bearing is also depicted.
Figure 12:
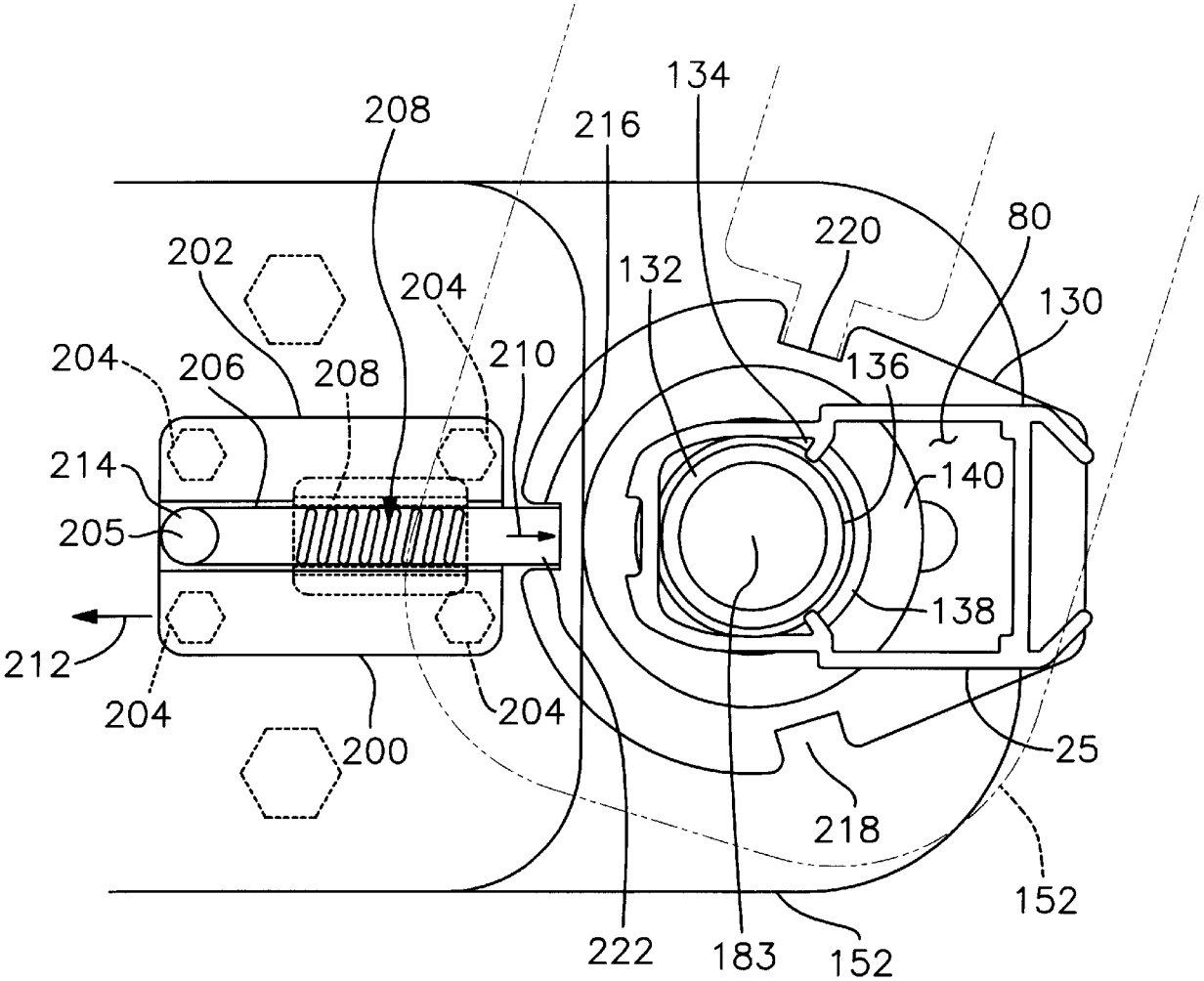
FIG. 12 is a cross sectional view taken along line 12—12 of FIG. 11.

Platform 22 is pivotally attached to the lower end of guided member 25 in the manner shown in FIG. 11. A lower mounting plate 130 is welded or otherwise permanently attached to the lower end of guide tube 25. The lower end of lubricating tube 94 extends to just above the lower end of guide 25. As shown in FIGS. 11 and 12, a reinforcing tube 132 extends through section 134 of guided member channel 80. The reinforcing tube extends through an opening 136 in plate 130 and through a cylindrical inner member 138 that is fixedly attached to and depends from plate 130. An outer tube or sleeve 140 is mounted rotatably to cylindrical element 138. A pair of upper and lower bearings 142 and 144 interengage inner member 38 and outer tube 140.

Cradle 24 is fixedly secured to rotatable outer tube 140. In particular, the cradle includes three elongate elements 146, 148 and 150, best shown in FIG. 11, which are superposed in a stacked or laminar manner. Upper and lower mounting brackets 152 and 154 are sandwiched about elements 146, 148 and 150 and secured thereto by connecting assemblies 156 and 158. The upper and lower brackets 152 and 154 are themselves welded or otherwise permanently fastened to rotating tube 140. As a result, cradle 24 extends transversely from tubular element 140 in a generally cantilevered manner. A gusset 160 strengthens the interconnection between the cradle and the rotating tube.

Figure 13:
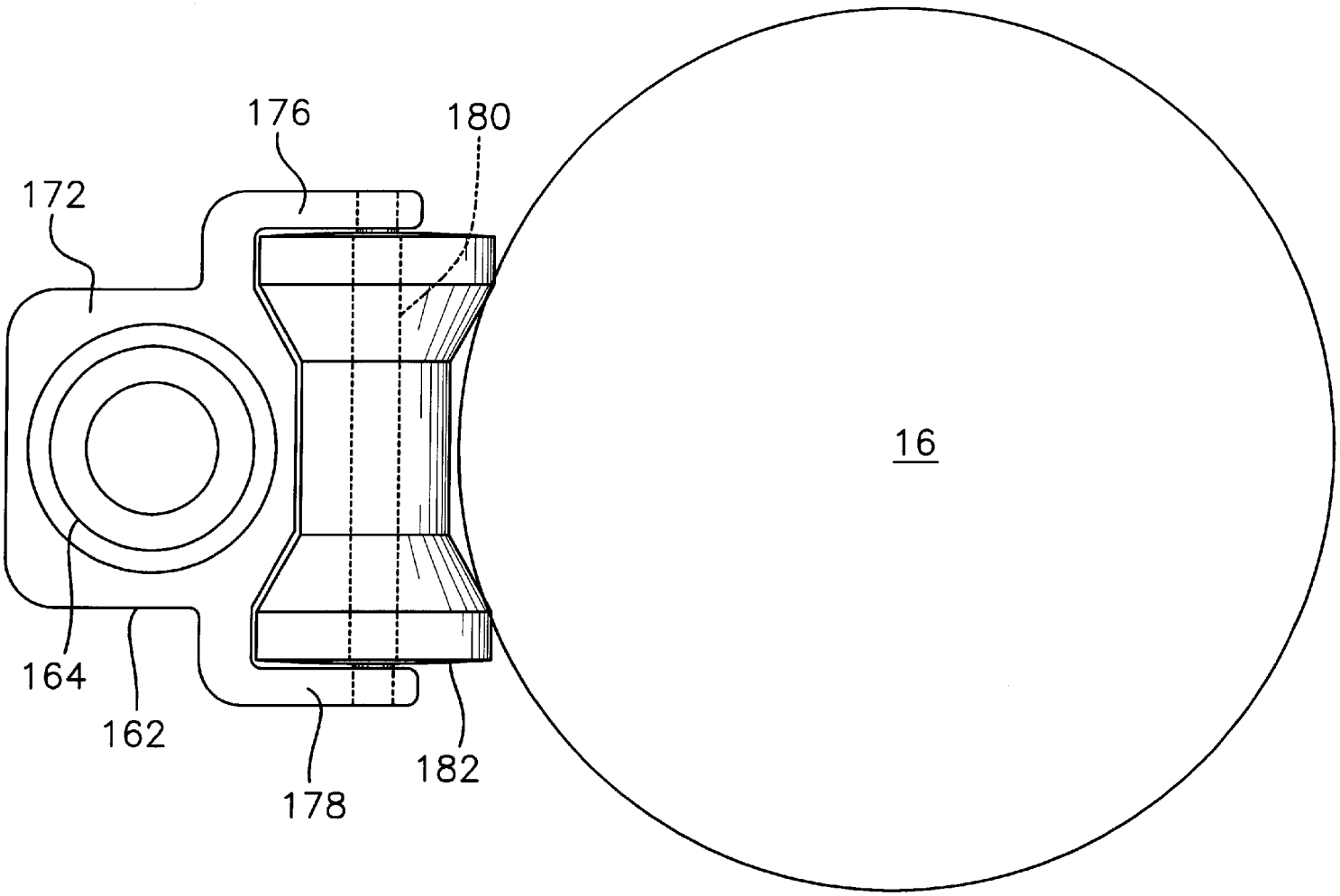
FIG. 13 is a cross sectional view taken along line 13—13 of FIG. 11.

A collar 162, FIGS. 11 and 13, supports rotating tube 140 on cylindrical member 138 and prevents the rotating tube from being separated from the inner member. In particular, collar 162 includes a central opening 164 that accommodates inner member 138 and the lower end of reinforcing tube 132. Collar 162 is secured to inner member 138 and reinforcing tube 132 by bolts 166, best shown in FIG. 11. Lower bearing 144 includes a peripheral flange 170, which interengages rotating tube 140 and an upper surface 172 of collar 162. As a result, rotating tube 140 is seated on an upper surface of collar 172.

Collar 162 also serves to support a rotatable guide bearing which comprises a roller to roll on piling 16. Other types of bearings may be employed. As shown in FIGS. 11 and 13, the collar includes a pair of arms 176 and 178 that are unitarily connected thereto and which extend in a spaced apart, parallel manner from the collar. A pin 180 extends between arms 176 and 178. Pin 180 supports a concave rotatable roller 182 thereon. Roller 182 engages piling 16 and bears against the piling rotatably. As the guided member 25 and attached cylindrical member 138, platform 22 and collar 162 are raised and lowered relative to the piling, roller 162 bears rotatably on the piling and guides the platform smoothly along the piling. The roller also helps to prevent undesirable inward cantilevering of piling 16. Roller 182 further prevents the platform from scuffing or binding against the piling and permits smooth raising and lowering of the boat lift. The concave shape of roller 182 helps the roller to remain engaged with the piling during the raising and lowering operation. This restricts the guide and the platform from shifting forwardly and rearwardly.

Figure 14:
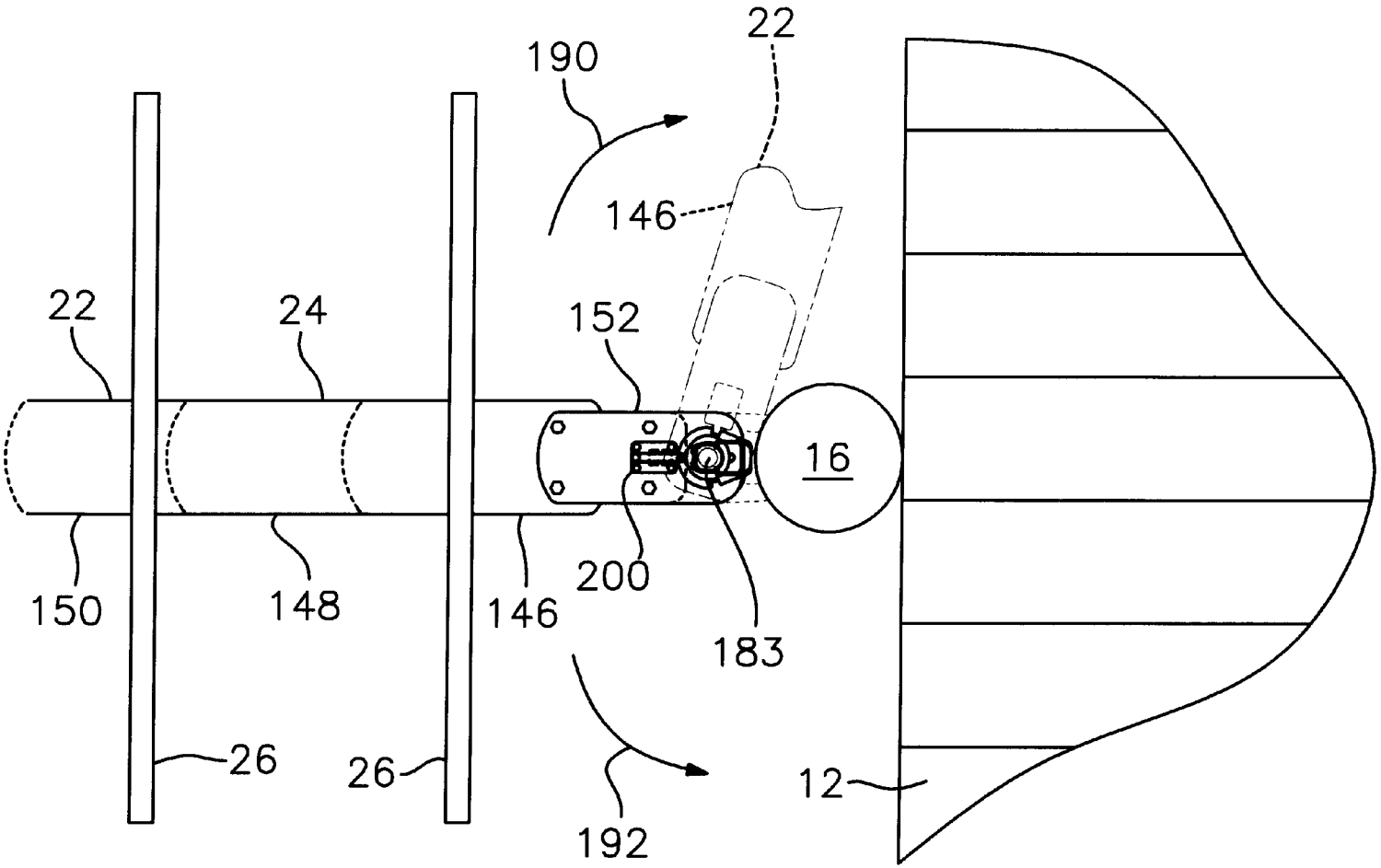
FIG. 14 is top view of the platform and the locking plate for holding the platform at a selected angular position about the piling.

Because outer tube 140 is mounted rotatably about inner cylindrical member 138, the entire platform 22 is pivotal about a vertical axis 183, shown in FIGS. 12 and 14. Specifically, upper and lower brackets 152, 154 and cradle elements 146, 148 and 150, which are permanently fastened to tube 140, rotate about cylindrical member 138 and axis 183. This permits the platform to be generally pivoted about piling 16. As best shown in FIG. 14, platform 22 is positioned relative to the piling such that the cradle 24 extends generally perpendicularly from dock 12. The platform is pivoted about the cylindrical member 138 and thereby about the axis 183 of reinforcing tube 132 of guided member 25. The platform may be adjusted relative to dock 12, as indicated by arrows 190 and 192 in FIG. 14. Platform 22 is turned in the direction of arrow 190 until it reaches the angular position indicated in phantom. Alternatively, platform 22 may be turned in the direction of arrow 192 until it reaches a corresponding angular position in a generally opposite direction. Such pivoting permits the platform and any watercraft carried thereon to be positioned adjacent to or over dock 12. The watercraft may then be conveniently serviced.

Means are provided for locking platform 22 in a selected rotational position about axis 183. Such means are depicted in FIGS. 11, 12 and 14. A locking assembly 200 includes a bracket 202 that is mounted to plate 152 by bolts 204. A latching member 205 is slidably mounted through a central slot 206 in bracket 202. A spring 208 urges latching member 205 longitudinally outwardly in the direction of arrow 210 but permits the latch 205 to be pulled rearwardly or retracted in the direction of arrow 212 by grasping handle 214 of latch element 205 and pulling in that direction.

A plurality of latching slots or recesses 216, 218 and 220 are formed in the plate 130, secured to the lower end of guide 25. The distal end 222 of latching element 205 is selectively engaged with one of the slots 216, 218 and 220 to hold the platform in a selected position about axis 183. When the platform is raised and lowered, it should be locked in the position illustrated in FIGS. 12, 13 and 14, wherein cradle 24 extends generally perpendicularly from dock 12. In that position, spring 208 urges element 205 in the direction of arrow 210 such that distal end 222 engages the slot 216 to lock the platform in place. To adjust the position, i.e. to rotate the position of the platform forwardly to the position illustrated in phantom in FIG. 14, the operator grasps handle 214 of latch element 205 and pulls the latch element rearwardly in the direction of arrow 212. This removes distal end 222 of latch element 205 from slot 216 of plate 130. As a result, the entire platform 22 is permitted to rotate, as indicated by arrows 190 and 192 in FIG. 14. To position the platform closer to dock 12 and forward of piling 16, the platform is simply rotated in the direction of arrow 190 until the distal end of latch element 205 points toward slot 220 in plate 130. The latch element is then released and spring 208 urges the distal end 222 of the latch element into slot 220. This locks the platform in the position shown in phantom in FIG. 14. The watercraft may then be conveniently removed from or mounted onto the boat lift platform via the dock. A similar locking operation permits the platform to be held in an opposite direction adjacent to the dock. In that case, the latching element is engaged with slot 218 in plate 130.

In operation, activation rod 112 is grasped and pushed upwardly. This urges activation switch 110 into its second state. Motor 72 is thereby driven in a first direction to raise the lift platform 22. Specifically, the pulley wheels 70 and 58 are operated so that shaft 52 turns in the direction of arrow 80. This raises nut 82 along shaft 52, which, in turn, retracts guided member 25 longitudinally within guiding member 30. The guided member pulls the attached platform upwardly until the guided member interengages upper limit switch 100. This deactivates motor 72 and stops the lift. Activation rod 112 is then typically released and allowed to return to its neutral position. The platform may then be pivoted, as previously described, by releasing latching element 205 from the slot 216 and adjusting the angle of the platform as required.

To lower the platform and a boat supported thereon, the platform is first pivotally adjusted, if necessary, to return the cradle to a position wherein it extends generally perpendicularly from the dock. In other words, the operator makes sure that latching element 205 is engaged with slot 216 in plate 130. The user then grasps activation rod 112 and pulls that rod downwardly so that switch 110 is urged into its third state. This causes motor 72 to rotate wheel 70 in the direction of arrow 74 and wheel 58 in the direction of arrow 78. This rotates shaft 52 axially in a similar direction, which causes nut 82 to be lowered along the shaft. The attached guided member 25 extends telescopically in a downward direction from guiding member tube 30. This lowers platform 22 in a positive manner until the platform is submerged beneath water line 14. When the guided member 25 approaches the lower end of guiding member 30, actuator bar 47 is pulled downwardly by lip 108. This opens lower limit switch 102 so that the motor is deactivated and the lift stops moving. The platform is halted at a lowermost desired position. Again, the activation rod may then be released and permitted to return to its neutral position.

The positive drive exhibited by the complementary nut and screw mechanism easily overcomes any buoyancy exerted by the water upon the lift platform. As a result, the watercraft is lowered reliably and safely into the water so that it can be successfully deployed. The use of a positive screw and nut drive mechanism eliminates the need for winches and cables. Accordingly, unintentional unraveling and untangling of the cables is eliminated and unlike conventional winch mechanisms, the lift does not rely on gravity to lower the lift platform. The lift platform and the boat do not free-fall. Additionally, the lift does not require intricate and expensive brake mechanisms.

As the guided member tube is raised and lowered relative to the guiding member tube, the shaft is respectively retracted into and extended from lubricating sleeve 94. This automatically lubricates and protects the shaft The interengaged screw shaft and nut operate reliably and for extended periods. The shaft is never exposed directly to the water or harsh marine environment and requires little maintenance or repair.

The lift of this invention is much more efficient and much less expensive than conventional boat lifts. The rotating screw shaft not only performs the lifting and lowering operation, it also provides the reduction (mechanical advantage) needed to produce the torque required for lifting. The cables and separate reduction means required by conventional lifts, as well as the complexity and expense attendant thereto, are eliminated.

The present invention also effectively insulates the electrical components of the boat lift and significantly reduces the risk of short circuits and electrical shocks. More particularly, the threaded metal shaft 52 and attached drive components of mechanism 27 are fully isolated from the water. Only the platform and guided member contact the water. The guided member is attached to the shaft by a nut that is formed of nylon or some other insulating material. Accordingly, the platform is electrically isolated from the drive mechanism through shaft 52. Similarly, guiding member 30 is fully insulated from guided member tube 25 by insulated bearing strips 33, 35 and 37. As the guided member is telescopically retracted into and extended from guiding member 30, flanges 55 and 57 engage insulated bearings 33 and 37, respectively. At the same time, guided member tube recess 53 interengages insulated bearing 35. These are the only points at which the guided member tube contacts the guiding member tube. Electrical short circuits between the guide tubes (and thus from the drive mechanism 27 to platform 22) are thereby prevented.

The insulation means of this invention may be employed with other types of lifts using actuators other than the complementary screw shaft and nut disclosed herein. For example, known cable driven boat lifts employ electrically conductive cables for raising and lowering the platform and some type of guide mechanism for guiding movement of the platform along the piling. One common type of guide comprises a roller mechanism secured to the piling and an elongate guided member fixed to the platform and movably interengaging the roller mechanism. In such devices, the dual insulation of this invention may be used equally effectively to electrically insulate the motor from the platform. Specifically, in such embodiments, the actuator includes the cables, which conductively contact the drive motor and the accompanying structure (e.g. pulleys, bearings, fixed attachments) connecting the cables to the platform. This type of actuator is insulated by employing a ceramic, plastic or otherwise non-conductive material to compose the pulley, bearing or fixed attachment. Likewise, the guide may utilize plastic, rubber or otherwise insulated rollers for engaging the guided member. These two means of insulation prevent electricity from being conducted from the electric motor and its casing to the platform through the actuator cables and guide, respectively. Short circuits and the risk of electrocution are reduced significantly. It should be understood that various types of first and second insulation means may be employed in an analogous manner for all sorts of lifts that use an actuator and a guide. In each case, one insulating component is contained in the actuator and the other in the guide.

As previously indicated, the lift may be operated using either one, two or four actuator assemblies 20. One actuator assembly is typically used for personal watercraft or other small vessels. Larger boats may require two or more actuator assemblies on the same or opposite sides of the vessel.

Piling 16 or other adjacent supports serve a very important function in lift 10. Not only does the piling bear the force or load of the lift, it also serves to guide the lift platform as it travels up and down. The guiding member 30 extends along the elongate piling 16 for substantially the entire length of member 30. As a result, the piling critically serves as a weight supporting component of the lift. Specifically, the piling effectively absorbs and distributes the weight of the vessel and platform evenly along the length of the piling. This is a significant improvement over known lifts wherein the weight of the vessel and platform are supported in a strictly cantilevered fashion. The present invention exploits the elongate piling and effectively handles loads that are significantly heavier than those which can be lifted by known boat lifts utilizing similar horsepower drive motors. Moreover, by using the piling to support and distribute the load, a stronger, more durable lift is provided. Frequent maintenance and replacement of the lift components are avoided.

The switch mechanisms allow the lift to be quickly and conveniently operated by a person located proximate the lift. A single handle permits the lift to be started, stopped and directionally directed, and at the same time, allows an auxiliary light to be turned on or off. The limit switches reliably and instantaneously stop the lift at predetermined uppermost and lowermost positions.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A boat lift apparatus for use in combination with an elongate, generally vertically disposed support piling located proximate a body of water, said apparatus comprising:

an elongate, threaded shaft disposed adjacent to the support piling and extending in a substantially vertical direction;

a nut that threadably engages said shaft;

a boat accommodating platform, which platform is interconnected to said nut; and means for rotatably mounting said shaft to said support piling such that said support piling is longitudinally loaded by and distributes the weight of said lift apparatus and a boat accommodated on said platform, and for selectively driving said shaft rotatably in a first direction to raise said nut on said shaft and in an opposite, second direction to lower said nut on said shaft, whereby said platform and a boat accommodated thereon are selectively lifted and lowered relative to the body of water.

2. The apparatus of claim 1 further including an elongate sleeve attached to and generally axially aligned with said nut, said sleeve longitudinally receiving said shaft as said nut is raised relative to said shaft and longitudinally discharging said shaft as said nut is lowered relative to said shaft.

3. The apparatus of claim 2 in which said sleeve contains means for lubricating said shaft as said shaft is received by and discharged from said sleeve.

4. The apparatus of claim 1 further including elongate guide means for interconnecting said platform and said support structure and guiding said platform relative to said support structure as said platform is lifted and lowered, said guide means including an elongate guiding member extending along the support structure and secured thereto and an elongate guided member interconnected between the nut and the platform and interengaging and being movable upwardly and downwardly relative to said guiding member.

5. The apparatus of claim 1 in which said means for mounting and driving include a wheel mounted rotatably on the support structure, said shaft being generally surrounded by and mounted axially in said wheel, said means for mounting and driving further including means for selectively turning said wheel in opposing first and second directions to respectively raise and lower said nut relative to said shaft.

6. The apparatus of claim 4 in which said upper guiding member includes a longitudinal channel that telescopically receives said guide member.

7. The apparatus of claim 6 further including an elongate sleeve attached to and generally axially aligned with said nut, said sleeve telescopically receiving said shaft.

8. The apparatus of claim 7 in which said guided member includes a longitudinal channel through which said sleeve extends and within which said nut is fixed to said guided member.

9. The apparatus of claim 4 further including thrust bearing means for axially rotatably interconnecting said shaft and said guiding member.

10. The apparatus of claim 4 further including pivot means for connecting said platform to said guided member such that said platform is pivotable about a generally vertical axis to adjust the position of a vessel supported on said platform relative to the support structure.

11. A boat lift apparatus for use in combination with an elongate, generally vertically disposed support piling located proximate a body of water, said apparatus comprising:

an elongate, threaded shaft disposed adjacent to the support piling and extending in a substantially vertical direction;

a nut that threadably engages said shaft;

a boat accommodating platform, which platform is interconnected to said nut;

means for rotatably mounting said shaft to said support piling such that said support piling is longitudinally loaded by and distributes the weight of said lift apparatus and a boat accommodated on said platform, and for selectively driving said shaft rotatably in a first direction to raise said nut on said shaft and in an opposite, second direction to lower said nut on said shaft, whereby said platform and a boat accommodated thereon are selectively lifted and lowered relative to the body of water; and guide means for interconnecting said platform and said support structure and guiding said platform relative to said support structure as said platform is lifted and lowered, said guide means including an elongate outer guiding tube extending along said support structure and secured thereto and a complementary guided tube interconnecting said nut and said platform and interengaging and being telescopically received by and movable upwardly and downwardly relative to said guiding member, said nut being fixed inside said guided tube and movable upwardly and downwardly on said shaft.

12. The apparatus of claim 11 in which said guiding member extends along and interengages said support structure for substantially the entire length of said guiding member.

13. A boat lift apparatus for use in combination with a support structure located proximate a body of water, said apparatus comprising:

an immersible platform for supporting a boat thereon;

an electrically powered drive mechanism mounted on said support structure above the water, said drive mechanism being selectively operated in opposing first and second directions;

actuator means in electrically conductive contact with said drive mechanism and interconnecting said drive mechanism and said platform for raising said platform when said drive mechanism is operated in a first direction and for lowering said platform when said drive mechanism is operated in said second direction;

said actuator means including first insulation means for electrically isolating said platform from said drive mechanism; and guide means in electrically conductive contact with said drive mechanism and interconnecting said support structure and said platform for guiding movement of said platform relative to said support structure;

said guide means including second insulation means for electrically isolating said platform from said drive mechanism.

14. A boat lift apparatus for use in combination with an elongate, generally vertically disposed support structure located proximate a body of water, said apparatus comprising:

an elongate, threaded shaft disposed adjacent to the support structure and extending in a substantially vertical direction;

a nut that threadably engages said shaft;

a boat accommodating platform, which platform is interconnected to said nut;

means for rotatably mounting said shaft to said support structure and selectively driving said shaft rotatably relative to said nut in a first direction to raise said nut relative to said shaft and in an opposite, second direction to lower said nut relative to said shaft, whereby said platform and a boat accommodated thereon are selectively lifted and lowered relative to the body of water;

an elongate guide means for interconnecting said platform and said support structure and guiding said platform relative to said support structure as said platform is lifted and lowered, said guide means including an elongate guiding member extending along the support structure and secured thereto and an elongate guided member interconnected between said nut and said platform and interengaging and being movable upwardly and downwardly relative to said guiding member; and pivot means for connecting said platform to said guided member such that said platform is pivotable about a generally vertical axis to adjust the position of a vessel supported on said platform relative to said support structure, said pivot means including a generally cylindrical inner member fastened to and depending from said guided member and a tubular outer member disposed rotatably about said inner member, means for interconnecting said tubular member and said platform and means for restricting said tubular member from being separated from said inner member.

15. A boat lift apparatus for use in combination with an elongate, generally vertically disposed support structure located proximate a body of water, said apparatus comprising:

an elongate, threaded shaft disposed adjacent to the support structure and extending in a substantially vertical direction;

a nut that threadably engages said shaft;

a boat accommodating platform, which platform is interconnected to said nut;

means for rotatably mounting said shaft to said support structure and selectively driving said shaft rotatably relative to said nut in a first direction to raise said nut relative to said shaft and in an opposite, second direction to lower said nut relative to said shaft, whereby said platform and a boat accommodated thereon are selectively lifted and lowered relative to the body of water;

said means for mounting and driving including a wheel mounted rotatably on said support structure, said shaft being generally surrounded by and mounted axially in said wheel, said means for mounting and driving further including means for selectively turning said wheel in opposing first and second directions to respectively raise and lower said nut relative to said shaft;

activation switch means alternatable among a first state for deactivating said means for turning such that said platform does not move vertically, a second state for activating said means for turning to raise said platform, and a third state for activating said means for turning to lower said platform; and an activation switch control member suspended from said means for mounting and driving and carrying means that are engagable with said activation switch means for urging said activation switch means into said second state when said control member is pushed longitudinally in an upward direction, into said third state when said control member is pulled longitudinally downwardly and allowing said activation switch means to remain in said first state normally.

16. The apparatus of claim 1 in which said means for mounting and selectively driving include an electrically powered mechanism mounted on said support structure above the water, said drive mechanism being selectively operated in opposing first and second directions to rotate said shaft in said first and second directions, said shaft being composed of an electrically conductive material and said nut being composed of an electrically insulated material that electrically isolates said platform from said drive mechanism.

17. The apparatus of claim 15 in which said means for restricting includes collar means attached to said inner member for supporting said tubular member thereon.

18. The apparatus of claim 15 further including guide bearing means carried by said collar means for interengaging said support structure and constraining the position of said platform relative to said support structure when said platform is lifted and lowered.

19. The apparatus of claim 15 further including means for locking said platform at a selected one of a plurality of angular positions about the generally vertical axis.

20. The apparatus of claim 19 in which said means for locking include a locking plate attached to said guided member and having a plurality of latching slots formed therein, and a latching pin retractably mounted to said platform, said pin being engaged with a selected one of said slots to lock said platform in a corresponding angular position and being retractably disengaged from said slots to permit said platform to be pivoted about the generally vertical axis.

21. The apparatus of claim 4 further including insulated bearing means for interengaging said guiding member and said guided member and electrically isolating said guiding member from said guided member.

22. The apparatus of claim 15 in which said guided member including an interior channel and further including a reinforcing component that is received by said interior channel and extends into said cylindrical member.

23. The apparatus of claim 4 further including upper limit switch means for directing said means for mounting and driving to stop rotation of said shaft and raising of said platform when said guided member reaches a predetermined uppermost position.

24. The apparatus of claim 4 further including lower limit switch means for directing said means for mounting and driving to stop rotation of said shaft and lowering of said platform when said guided member reaches a predetermined lowermost position.

25. The apparatus of claim 15 in which said platform includes a cradle and means for connecting said cradle to said tubular member such that said cradle extends outwardly from said tubular member in a cantilevered manner.

* * * * *